United States Patent [19]

Murphy

[11] Patent Number: 4,684,328

[45] Date of Patent: Aug. 4, 1987

[54] ACOUSTIC PUMP

[75] Inventor: Donald Murphy, Wellesley, Mass.

[73] Assignee: Piezo Electric Products, Inc., Cambridge, Mass.

[21] Appl. No.: 821,863

[22] Filed: Jan. 22, 1986

Related U.S. Application Data

[63] Continuation of Ser. No. 625,704, Jun. 28, 1984, abandoned.

[51] Int. Cl.[4] ..... F04B 17/00

[52] U.S. Cl. ..... 417/322; 417/410; 417/436; 416/83; 310/330

[58] Field of Search ..... 417/240, 241, 322, 410, 417/413, 436; 416/3, 79, 81, 82, 83; 310/328, 330, 332, 348

[56] References Cited

U.S. PATENT DOCUMENTS

| | | | |
|---|---|---|---|
| 2,932,494 | 4/1960 | Wales | 416/81 |
| 3,040,976 | 6/1962 | De Mattos | 417/436 |
| 4,342,936 | 8/1982 | Marcus et al. | 310/330 |
| 4,498,851 | 2/1985 | Kolm et al. | 417/322 |

FOREIGN PATENT DOCUMENTS

| | | | |
|---|---|---|---|
| 477143 | 12/1914 | France | 416/83 |
| WO80/02445 | 11/1980 | PCT Int'l Appl. | 417/322 |
| 289372 | 3/1953 | Switzerland | 417/436 |
| 2044705 | 10/1980 | United Kingdom | 416/79 |
| 2049594 | 12/1980 | United Kingdom | 416/79 |
| 2071924 | 9/1981 | United Kingdom | 310/332 |

OTHER PUBLICATIONS

Fitzpatrick, "Natural Flight & Related Aeronautics", *Institute of the Aeronautical Sciences*, 7-1952, p. 5.

"A Piezoelectric Cooling Fan", *Computers & Electronics*, 3-1983, p. 104.

Toda, "Vibrational Fan Using the Piezoelectric Polymer $PVF_2$", *Proceedings of the IEEE*, vol. 67, Aug. 1979, p. 1171.

*Primary Examiner*—Carlton R. Croyle

*Assistant Examiner*—Donald E. Stout

*Attorney, Agent, or Firm*—Joseph S. Iandiorio; William E. Noonan

[57] ABSTRACT

An acoustic pump including a resonant member having low internal damping and asymmetrically tapered to a thin edge; a piezoelectric driver mounted on the resonant member; and means for applying an alternating voltage to the piezoelectric driver in the resonant range of the resonant member for vibrating the resonant member and pumping fluid away from the thin edge.

47 Claims, 11 Drawing Figures

ACOUSTIC PUMP

This is a continuation of application Ser. No. 625,704, filed June 28, 1984 now abandoned.

FIELD OF INVENTION

This invention relates to an acoustic pump, and more particularly to such a pump which is ultrasonically piezoelectically driven.

BACKGROUND OF INVENTION

Piezoelectric blade blowers are known which are much smaller than the smallest rotary fans and are used to cool electronic equipment. These blowers are highly efficient, have long life, generate little noise or magnetic interference and are approximately two inches by one inch by three quarters of an inch in size. However, they too have drawbacks. They are not small enough for direct mounting on printed circuit boards and they require a 115-volt, 60-line current, which introduces 60 Hz magnetic noise in the circuit boards as well as requiring that a 115-volt source be made available at the board. Attempts to use a piezoelectric crystal directly to pump air by acoustic streaming have also been less than successful because large crystals are required which are difficult and expensive to obtain in production. Acoustic streaming results from the fact that air accelerated by an oscillating surface does not reverse its direction when the surface does, due to inertia and compressibility, further complicated at higher amplitudes by turbulence and vortex formation.

SUMMARY OF INVENTION

It is therefore an object of this invention to provide an improved smaller, highly efficient, high velocity acoustic pump.

It is a further object of this invention to provide such a pump which may be mounted directly to a printed circuit board and is comparable in size to the components it cools.

It is a further object of this invention to provide such a pump which operates on low voltage.

It is a further object of this invention to provide such a pump which operates in the ultrasonic range virtually inaudibly and without vibration.

It is a further object of this invention to provide such a pump which produces very high airflow.

It is a further object of this invention to provide such a pump which has virtually unlimited service life, no magnetic disturbance, no heat generation and does not draw a high starting current.

It is a further object of this invention to provide such a a pump which is mountable on a printed circuit board and pumps parallel to the board.

It is a further object of this invention to provide such a a pump which may make use of acoustic streaming.

This invention results from the realization that a truly effective, small, high-velocity, high-volume piezoelectric pump can be made by using a resonant member with low internal damping and asymmetrically tapered to a thin edge driven by a piezoelectric member to vibrate the member in an open node pattern that intersects with the thin edge.

This invention features an acoustic pump which includes a resonant member with low internal damping and asymmetrically tapered to a thin edge. A piezoelectric driver is mounted on the resonant member. There is some means for applying an alternating voltage to the piezoelectric driver in the resonant range of the resonant member for vibrating the resonant member and pumping fluid away from the thin edge.

In a preferred embodiment the piezoelectric driver is mounted on the resonant member remote from the thin edge and the resonant member vibrates in a node line pattern which intersects with the thin edge. The node line may be an open node line pattern, may be generally circular and may have two inflection points near its intersection with the thin edge. The resonant member may be mounted remote from the thin edge. The node line pattern may intersect with the thin edge. The perforated plate may be mounted on the resonant member above the inflection points. The perforated plate may also be mounted below the tapered surface and may be planar or have other configurations, such as an inverted V channel.

Preferably there is a perforated plate spaced above the tapered surface. The perforated plate is located at a position of dynamic equilibrium between the acoustic pressure exerted away from the surface and the recoil pressure exerted toward the tapered surface. The perforated plate may be loosely mounted above the tapered surface to permit the plate to seek its position of dynamic equilibrium between the acoustic pressure exerted away from the surface and the recoil pressure exerted toward the tapered surface.

The resonant member may be asymmetrically tapered to two thin edges and it may include a generally planar section from which the tapered portion extends. The piezoelectric driver may be mounted on the bottom of the resonant member, on the top or on a side. The means for applying may include an electrode on the opposite side of the piezoelectric driver from the resonant member. The resonant member itself may function as one of the electrodes for the piezoelectric driver.

The perforated plate may be made of metal, may include approximately 270 holes per square inch, and the holes may be approximately 0.007 to 0.01 inch in diameter. The perforations may be formed with generally conical walls converging away from the tapered surface. The node line pattern is generally circular and has two inflection points near its intersection with the thin edge. The acoustic pump may be used as an ultrasonic blower.

DISCLOSURE OF PREFERRED EMBODIMENT

Other objects, features and advantages will occur from the following description of a preferred embodiment and the accompanying drawings, in which.

Figure 1:
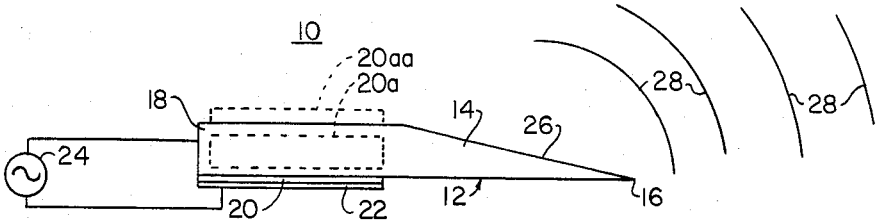
FIG. 1 is a schematic side view of an acoustic pump according to this invention.

There is shown in FIG. 1 an acoustic pump 10 in the form of an ultrasonic blower having a resonant member 12 with an asymmetrically tapered section 14 that tapers to a thin edge 16. Member 12 also includes a generally planar section 18, FIG. 2. A piezoelectric driver 20 is mounted on the resonant member remote from the thin edge 16, although it will work close to the edge as well. It may be mounted on the bottom, as shown in FIG. 1, or on one of the sides 20*a* or the top 20*aa*, as shown in phantom in FIG. 1. An electrode 22 is provided on the outer surface of piezoelectric driver 20 and the resonant member, providing it is sufficiently conductive, may act as the other electrode for applying an oscillating electric current to the piezoelectric driver 20 by means of an alternating current source 24. With the application of the oscillating current, tapered surface 14 vibrates and causes an acoustic streaming effect which pumps air away from thin edge 16, as illustrated by the compressive wave fronts 28. The overall size of resonant member 12 may be approximately 1.075 inches in width, 1.275 inches in length, and 0.25 inch in thickness or height.

Piezoelectric driver 20 may be made of PZT-58 piezoceramic supplied by Piezo Electric Products, Inc., or the equivalent, approximately 0.98 inch in diameter and 0.01 inch in thickness. It may be nickel plated on both sides to form electrode 22 on one side and a binding surface for attachment to the aluminum resonant member 12 using Locktite Type 404 cement or the equivalent.

Figure 3:
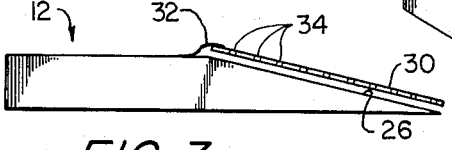
FIG. 3 is a view similar to FIG. 1 showing the resonant member with an amplifying membrane mounted over the tapered surface.
Figure 3A:
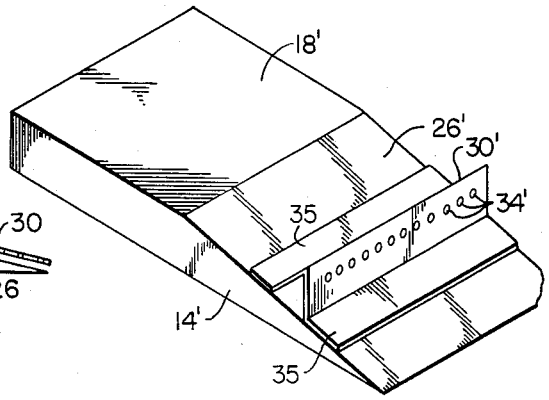
FIG. 3A is an axonometric view of an alternative form of amplifying membrane.
Figure 4:
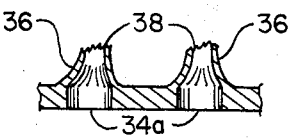
FIG. 4 is an enlarged cross sectional view showing the holes in a portion of the amplifying membrane of FIG. 3.

An amplifying membrane, perforated plate 30 with holes 34, FIG. 3, may be applied by attaching it with a flexible hinge 32 to resonant member 12 so that it floats over tapered surface 26 at the optimum level. This level is self-regulating so that when perforated plate 30 is loosely held in place it automatically levitates above the oscillating tapered surface 26 until it reaches a position of dynamic equilibrium between the acoustic pressure exerted away from the surface 16 and the recoil pressure which is exerted toward the surface 16. Although the membrane is shown above the surface and of generally planar shape, this is not a necessary limitation of the invention. For example the membrane may be mounted spaced from the bottom of the tapered surface and may take the form of an inverted "V" channel 30', FIG. 3A, with holes 34' facing in the direction of air movement. The flanges 35 may be secured to surface 26' but the perforated portion with holes 34', as in other constructions, is spaced above the surface. The effect of the amplifying membrane is not fully understood in detail; however, it appears that the levitation of the membrane, as explained, occurs at the height at which the downward pressure due to ejected air just balances the upward pressure due to the stream of entrained air below the membrane. It is found that plate 30 works well with approximately 270 holes per square inch having a diameter of 0.007–0.01 inch. Holes have been constructed by punching through a brass plate 0.002 inch thick, 1.075 inches long, and 0.65 inch wide. Good results have been found when the punched holes 34*a*, FIG. 4, which have conical protrusions 36 which converge away from surface 26 and end in ragged edges 38. The acoustic pump 10 of FIG. 1 delivers good performance, but its results are even more spectacular when a perforated plate 30 is used in combination with it.

Figure 5:
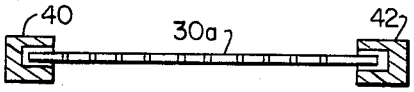
FIG. 5 is an end view with parts in cross section of an alternative mounting for the amplifying membrane.

Resonant member 12 is made of a material having low internal damping, or high "Q", in the range of 300 and higher, such as tempered aluminum alloys or carbon steel. Using the aluminum alloy 2024T-561 driven at its first harmonic with a 34 KHz square wave, 12-volt peak-to-peak source, the blower consumes 1.3 watts of power and delivers an air flow of 2 $ft.^3$/min. at an average velocity of 475 ft./min., and a peak velocity of 1400 ft./min. with no significant temperature rise. Under these conditions the perforated plate 30 levitates at a height of 0.003 inch above tapered surface 26. When the levitation height is known plate 30*a*, FIG. 5, may be fixed in position at that point by being clamped in suitable mountings which grip it tightly, as shown in mountings 40, 42, or it could be gripped in a mounting which only loosely surrounds the edge of perforated plate 30*a* to enable it to self-regulate its height in the same manner as permitted by flexible hinge 32, FIG. 3.

Figure 6:
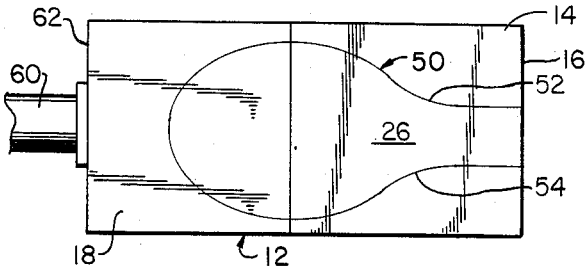
FIG. 6 is a top view showing a mounting technique for and the open node line pattern developed by the resonant member.
Figure 7:
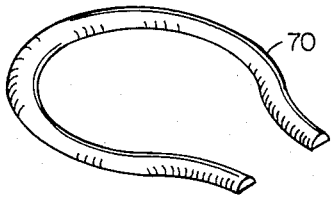
FIG. 7 is an alternative node line mounting member for mounting the resonant member of FIG. 1.

The invention utilizes a node pattern 50, FIG. 6, which is generally circular in shape, is open at the thin edge 16 and contains inflections 52, 54 near edge 16. The perforated plate is preferably located over the inflections. The thin edge is necessary in the configuration of the resonant member 12 in order to produce the open node pattern which results in the high amplitude pumping action that moves the air through the acoustic streaming phenomenon. Resonant member 12 may be mounted to a printed circuit board or other environmental structure by means of an arm 60 mounted to the back side 62 remote from tapered surface 26 and 16; or it may be mounted by using a node pattern support 70, FIG. 7, such as a half round rubber element formed in the shape of node pattern 50 and adhered to the underside of member 12 beneath the node line 50.

Figure 2:
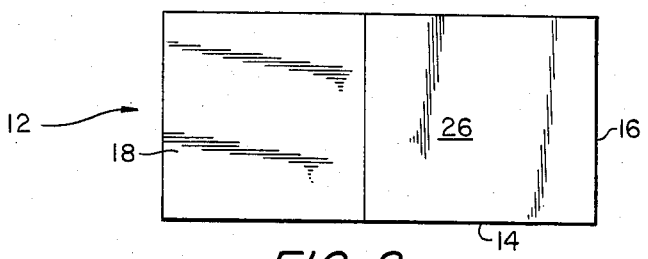
FIG. 2 is a top plan view of the resonant member portion of the pump of FIG. 1.
Figure 8:
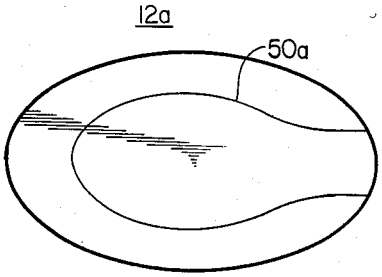
FIG. 8 is a top plan view of an elliptical resonant member showing its node line pattern.
Figure 9:
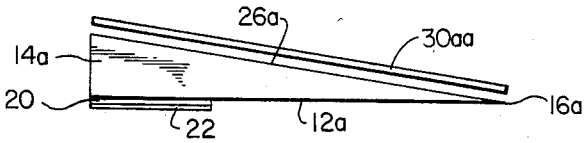
FIG. 9 is a side view of the elliptical member of FIG. 8.

Resonant member 12 is not restricted to the particular shape shown in FIGS. 1 and 2. For example, it may have a generally elliptical shape 12*a*, FIG. 8, which provides the same type of node line pattern 50*a* when it is tapered to a thin edge 16*a*, FIG. 9, and has the same type of tapered surface 26*a*. Elliptical member 12*a*, FIG. 9, does not have the extra generally planar section 18 but includes only the tapered portion 14*a*. Elliptical resonant member 12*a* may be 0.125 inch thick with a 1.35 inch major axis and a 1.25 inch minor axis.

Figure 10:
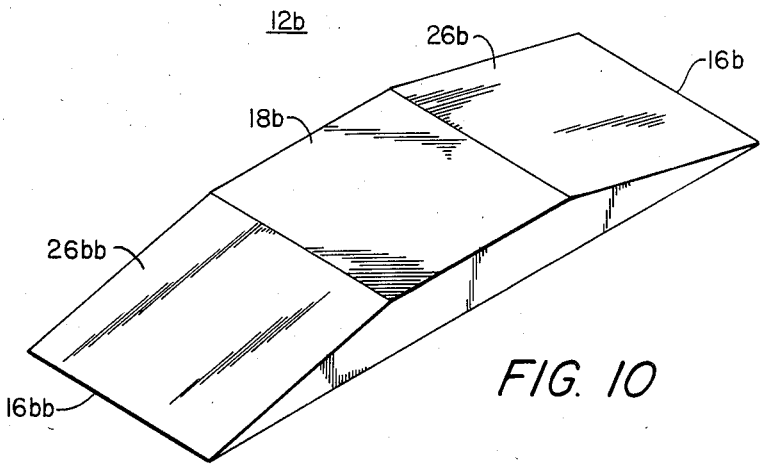
FIG. 10 is a view of a resonant member which has two sections asymmetrically tapered to a thin edge.

The resonant member is not limited to a single thin edge and tapered surface; for example, as shown in FIG. 10, member 12*b* may include a planar section or slab 18*b* which has two tapered surfaces 26*b* and 26*bb* terminating in thin edges 16*b* and 16*bb*, which can be used for similar acoustic pumping using similar acoustic techniques.

Other embodiments will occur to those skilled in the art and are within the following claims:

What is claimed is:

1. An ultrasonic pump comprising:

a resonant member having low internal damping and asymmetrically tapered to a thin edge;

a driver mounted on said resonant member; and means for applying an alternating voltage to said driver in the resonant range of said resonant member for vibrating said resonant member in an open node line pattern which intesects with said thin edge.

2. The ultrasonic lump of claim 1 wherein said driver includes a thin piezoelectric element.

3. The ultrasonic pump of claim: 1 further including means for mounting a perforated plate adjacent said tapered surface at the position of dynamic equilibrium between the acoustic pressure away from the surface and the recoil pressure toward said tapered surface.

4. The ultrasonic of claim 3 further including means for loosely mounting said perforated plate adjacent said tapered surface to permit said plate to seek its position of dynamic equilibrium between the acoustic pressure away from the surface and the recoil pressure toward said tapered surface.

5. The ultrasonic pump of claim 1 in which said resonant member is asymmetrically tapered to two thin edges.

6. The ultrasonic pump of claim 1 in which said resonant member includes a generally planar section.

7. The ultransonic pump of claim 1 in which said driver is mounted on the bottom of said resonant member.

8. The ultransonic pump of claim 1 in which said driver is mounted on the top of said resonant member.

9. The ultrasonic pump of claim 1 in which said driver is mounted on the side of said resonant member.

10. The ultrasonic pump of claim 1 in which said means for applying includes an electrode on the opposite side of said driver from said resonant member.

11. The ultransonic pump of claim 1 in which said resonant member functions as an electrode for said driver 12. The ultrasonic pump of claim 3 in which said perforated plate includes approximately 270 holes per square inch.

13. The ultrasonic pump of claim 3 in which the perforations in said perforated plate are approximately 0.007–0.01 inch in diameter.

14. The ultrasonic pump of claim 4 in which said perforated plate is metal.

15. The ultransonic pump of claim 3 in which the perforations are formed with generally conical walls converging away from said tapered surface.

16. The ultrasonic pump of claim 3 in which said perforated plate is generally planar.

17. The ultrasonic pump of claim 3 in which said perforated plate is an inverted "V" channel.

18. The ultrasonic pump of claim 1 including means for mounting said resonant member remote form said thin edge.

19. The ultrasonic pump of claim 1 in which said node line pattern has two inflection points near its intersection with said thin edge.

20. The ultrasonic pump of claim 1 in which said node line pattern is generally circular.

21. The ultrasonic pump of claim 1 in which said node lines pattern has two inflection points near its intersection with said thin edge and means for mounting a perforated plate on said resonant member adjacent said inflection points.

22. The ultrasonic pump of claim 1 in which the Q-factor of said resonant member is greater than 300.

23. The ultrasonic pump of claim 1 in which said resonant member is made of material selected from the group consisting of tempered aluminum alloys and carbon steel.

24. An ultrasonic pump comprising:

a resonant member having a Q-factor greater than 300 and including a first end, a second opposite end tapered to a thin edge, and at least one surface interconnecting said first and second ends; of a driver mounted on said interconnecting surface said resonant member remote from said thin edge; and means for applying an alternating voltage to said driver in the resonant range of said resonant member for vibrating said resonant member in an a generally circular open node line pattern which intersects with said thin edge and has two inflection points near its intersection with said thin edge.

25. The ultrasonic pump of claim 24 wherein said driver comprises a thin piezoelectric driver element distinct from and mounted on said resonant member.

26. The ultrasonic pump of claim 24 further including means for mounting a perforated plate above said tapered surface at the position of dynamic equilibrium between the acoustic pressure away from the surface and the recoil pressure toward said tapered surface.

27. The ultrasonic pump of claim 24 in which said resonant member is made of material selected from the group consisting of tempered aluminum alloys and carbon steel.

28. An ultrasonic blower comprising:

a resonant member having low internal damping and asymmetrically tapered to a thin edge;

a piezoelectric driver mounted on said resonant member;

a perforated plate mounted on said resonant member spaced from said tapered surface; and means for applying an alternating voltage to said piezoelectric driver in the resonant range of said resonant member for vibrating said resonant member in an open node line pattern which intersects with said thin edge and pumps fluid away from said thin edge.

29. An ultrasonic pump comprising:

a resonant member having low internal damping and asymmetrically tapered to a thin edge;

a driver mounted on said resonant member;

means for applying an alternating voltage to said driver in the resonant range of said resonant member for vibrating said resonant member; and means for mounting a perforated plate adjacent said tapered surface at the position of dynamic equilibrium between the acoustic pressure away from the surface and the recoil pressure toward said tapered surface.

30. The ultrasonic pump of claim 29 wherein said driver includes a thin piezoelectric element.

31. The ultrasonic pump of claim 29 in which said resonant member is asymmetrically tapered to two thin edges.

32. The ultrasonic transducer of claim 29 in which said resonant member includes a generally planar section.

33. The ultrasonic pump of claim 29 in which said driver is mounted on the bottom of said resonant member.

34. The ultrasosnic pump of claim 29 in which said driver is mounted on the top of said resonant member.

35. The ultrasonic pump of claim 29 in which said driver is mounted on the side of said resonant member.

36. the ultrasonic pump of claim 29 in which said means for applying includes an electrode on the opposite side of said driver from said resonant member.

37. The ultrasonic transducer of claim 29 in which said resonant member functions as an electrode for said driver.

38. The ultrasonic pump of claim 29 in which said perforated plate includes approximately 270 holes per square inch.

39. The ultrasonic pump of claim 29 in which the perforations in said perforated plate are approximately 0.007–0.01 inch in diameter.

40. The ultrasonic pump of claim 29 in which said perforated palte is metal.

41. The ultrasonic transducer of claim 29 in which the perforations are formed with generally conical walls coverging away from said tapered surface.

42. The ultrasonic pump of claim 29 in which said perforated plate is generally planar.

43. The ultrasonic pump of claim 29 in which said perforated plate is an inverted "V" channel.

44. The ultrasoinc pump of claim 29 in which said resonant member is mounted remote from said thin edge.

45. The ultrasonic pump of claim 29 wherein said resonant member is made of a material selected from the group consisting of tempered aluminum alloys and carbon steel.

46. The ultrasonic pump of claim 29 in which the Q-factor of said resonant member is greater than 300.

47. An ultrasonic pump comprising:

a resonant member having low internal damping and asymmetrically tapered to a thin edge;

a driver mounted on said resonant member;

means for applying an alternating voltage to said driver in the resonant range of said resonant member for vibrating said resonant member; and means for loosely mounting a perforated plate adjacent said tapered surface to permit said plate to seek its position of dynamic equilibrium between the acoustic pressure away from the surface and the recoil pressure toward said tapered surface.

* * * * *